United States Patent [19]

Revils et al.

[11] Patent Number: 4,674,569

[45] Date of Patent: Jun. 23, 1987

[54] STAGE CEMENTING TOOL

[75] Inventors: Ernest A. Revils, Montegut; Emmet J. Arboneaux, III, Thibodeaux; Brent J. Lirette, Houma, all of La.

[73] Assignee: Chromalloy American Corporation, St. Louis, Mo.

[21] Appl. No.: 845,613

[22] Filed: Mar. 28, 1986

[51] Int. Cl.[4] ..... E21B 33/16; E21B 34/14

[52] U.S. Cl. ..... 166/154; 166/289; 166/318

[58] Field of Search ..... 166/289, 285, 154, 156, 166/317, 319, 240, 318

[56] References Cited

U.S. PATENT DOCUMENTS

| | | | |
|---|---|---|---|
| 1,487,721 | 3/1924 | Clayton | 166/240 X |
| 2,435,016 | 1/1948 | Pitts | 166/289 X |
| 2,436,525 | 2/1948 | O'Donnell | 166/240 X |
| 3,131,767 | 5/1964 | Chancellor et al. | 166/156 X |
| 3,345,826 | 10/1967 | Hignite | 166/240 X |
| 4,176,717 | 12/1979 | Hix | 166/154 X |
| 4,260,017 | 4/1981 | Nelson et al. | 166/289 X |
| 4,421,165 | 12/1983 | Szarka | 166/289 |
| 4,487,263 | 12/1984 | Jani | 166/154 X |

*Primary Examiner*—James A. Leppink

*Assistant Examiner*—David J. Bagnell

*Attorney, Agent, or Firm*—Haverstock, Garrett and Roberts

[57] ABSTRACT

A stage cementing tool comprising a substantially tubular mandrel having a single interior unitary sleeve maintained at a first or closed position in said mandrel and adapted to move to a second or open position and subsequently to a third or closed position in said mandrel. The movable unitary sleeve is maintained by interior shear pins adapted to be sheared in two steps by separate forces applied at different points of the assembly of the unitary sleeve and respective opening and closing seats secured thereto. Positive locking means are located in the sleeve which act to maintain it at each successive position and to prevent regression when the moving force is removed. The mandrel and assembly is adapted to fit in a string of casing pipe for location at a site to be cemented. In operation the unitary sleeve is first actuated to open position for cement flow and placing and thereafter to fully closed position to stop such flow and is positively locked in such closed condition. Subsequent removal of the opening and closing seats and actuating members by drilling out provides for passage of a drill pipe string.

1 Claim, 4 Drawing Figures

STAGE CEMENTING TOOL

This invention is directed to a novel stage cementing tool and more particularly to such a stage cementing tool utilizing a single moving part to perform both the opening and closing steps in a stage cementing operation.

BACKGROUND OF THE INVENTION

It is conventional practice in the oil and gas industry to cement casing in well bores. The cement is placed in the annulus between the casing and the well bore, and is intended to secure and support the casing in the well bore and to isolate various formations from one another by preventing migration of formation fluids up and down the well bore. The cement is generally pumped down the casing interior, out into the well bore annulus, and back up toward the surface to the desired level. Secondary and tertiary cementing operations are very often utilized to isolate producing horizons from migrating water or other well fluids from other levels. Such cementing thus occurs along the length of the casing pipe string after primary cementing of the foot of the casing string at the desired level. Accurate location of the higher level cement columns or cement plugs and use of only the appropriate amounts of cement slurry for each of such intervening locations is highly desirable. Likewise, the ability to remove any cementing apparatus which might interfere with further down-hole operations with a drill stem is necessary for further treatment and development of the well.

Secondary and tertiary stage cementing serves several desirable purposes. By lowering hydrostatic weights and pump pressures, it reduces the potential for formation damage. It cuts material cost when cementing widely separated intervals. It minimizes cement contamination. Stage cementing also is useful in placing retarded slurries in hot bottom-hole temperatures, when such cement might fail to set if allowed to rise to a cooler zone.

Cementing tools of the prior art generally have required separate mechanisms to perform the required steps of opening passages for the cement being charged to be deposited in the annulus of the casing and into the surrounding formation and thereafter securely closing such passages until the cement charge has hardened and cured. Often additional collars and baffles have been required to prevent such cement from backing up in the interior of the casing when positive hydrostatic pressure from the surface is released. All these added items of equipment have served to multiply the difficulties, increase the costs and afford more opportunities for failure of the desired cement plugs.

SUMMARY OF THE INVENTION

In contrast to the prior art, the stage cementing tool of the present invention employs only one unitary moving sleeve to accomplish both the opening and closing steps of the cementing operation and employs a plurality of positive lock-down means to ensure that no regressive movement of that sleeve can occur after the removal of the positive hydrostatic pressure from the top of the casing. The positive seals built into the tool of this invention likewise serve to protect the casing from any migration of well fluids between the unitary sleeve and the wall of the tool which is installed integral with the casing. Furthermore, the present invention provides, by independent positive anti-rotation stops, for relatively easy removal of the interior seats and parts by drilling out after the cement plug has hardened and cured so that subsequent down-hole operation of a drill stem can be accomplished. The cementing tool of the present invention furthermore is readily adapted for use in placing a tertiary cement plug at a different lower location in the casing string.

BRIEF DESCRIPTION OF THE DRAWINGS

The stage cementing tool of the present invention will be better understood by reference to the following detailed description of its construction and operation taken in conjunction with the appended drawings wherein.

DETAILED DESCRIPTION OF THE PREFERRED EMBODIMENTS

Figure 1:
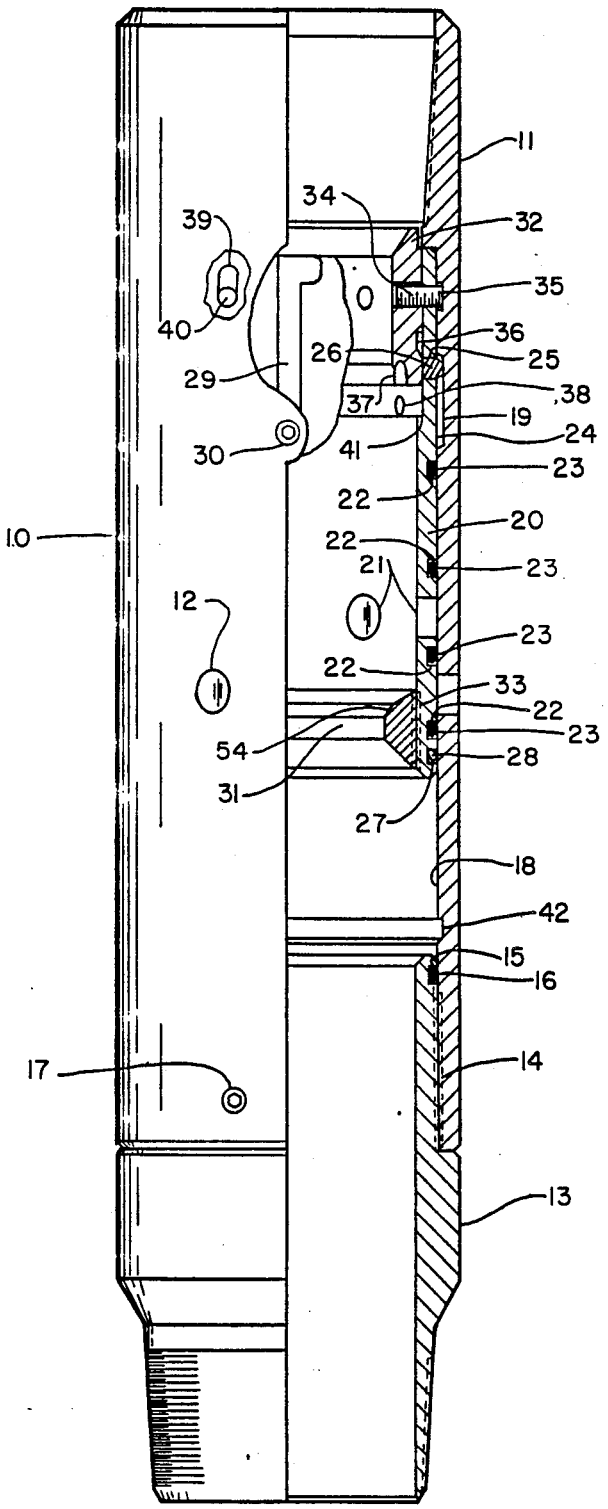
FIG. 1 is a partial section elevation of the present invention as it is ready to be run into the well bore as a part of the casing string.

A detailed description is made hereinafter of the stage cementing tool of the present invention wherein the same numerals are used to designate the same parts in each figure of the drawings. With reference to FIG. 1 of the drawings, there is illustrated the tool of the present invention in its original or going in the hole configuration.

The main body portion 11 of the cementing tool 10 comprises a tubular mandrel having a plurality of circumferentially spaced apertures 12 through the tubular mandrel wall. The lower end of the tool 10 terminates in another tubular mandrel sub-section 13 which is secured to the main body portion 11 of the tubular mandrel by means of a threaded joint 14. Such terminal sub-section 13 is provided with an annular slot 15 in which is disposed a sealing means 16 which may be an elastomeric O-ring to effect a hydrostatic seal between the tubular mandrel terminal sub-section 13 and the main body portion 11. The main body portion 11 is also provided with one or more threaded holes for accepting set screws 17 which terminate in the wall of the terminal sub-section 13 to prevent rotation of the sub-section 13 with respect to the main body portion 11 of the tubular mandrel.

An interior unitary sleeve 20 is situated within and abutting the interior wall 18 of the tubular main body portion 11. This interior unitary sleeve 20 also has circumferentially spaced apertures 21 formed through the wall thereof. The interior unitary sleeve 20 is provided with a plurality of annular grooves 22 in its outer wall which are provided with sealing means 23 such as elastomeric O-rings to form positive hydrostatic seals between the outer wall 24 of the interior unitary sleeve 20 and the interior wall 18 of the main body portion 11. Additionally, the interior unitary sleeve 20 is provided with a series of circumferentially spaced slots 25 proximate to the upper or closing seat end thereof which are provided with arc-shaped locking lugs 26 which project into slotted recesses 19 in the inside wall of the main body portion 11 and which serve as positive stops for the subsequent movement of the interior unitary sleeve 20. At the opposite end of the interior unitary sleeve 20 there is provided an annular recess 27 which carries a snap ring 28 adapted to serve as a positive lock with an annular undercut 42 in the wall 18 of main body portion 11 at a later stage of movement of the interior unitary sleeve 20. The interior unitary sleeve 20 is further provided with an L-shaped slot 29 which is adapted to receive an antirotation and guide pin 30 fixedly attached to the main body portion 11 and adapted to move within the slot in the interior unitary sleeve 20 and to serve as a guide to maintain the alignment of the apertures 21 in the interior unitary sleeve with apertures 12 in the main body portion 11.

The interior unitary sleeve 20 also carries first and second movement-actuated seats 31 and 32 near the opposite ends thereof. At the lower end thereof there is located the first or opening seat 31 which is fixedly attached to the interior unitary sleeve 20 as shown in FIG. 1 by means of reverse threads 33. Such opening seat 31 can also be further secured by the use of adhesive cement. At the upper end of the interior unitary sleeve 20 a second or closing seat 32 is located. The closing seat 32 is secured to the interior unitary sleeve 20 and to the main body portion 11 by means of a plurality of shear pins 34. Shear pins 34 pass through the upper portion of the closing seat 32 as well as through the interior unitary sleeve 20 and into a recess 35 in the interior wall of the main body portion 11 as shown in FIG. 1. The closing seat 32 is also provided with an annular groove 36 in the outer wall thereof adapted to receive the locking lugs 26 at a later stage of movement of the unitary sleeve. In addition, at the lower portion of the closing seat 32 there is provided a slotted recess 37 adapted to receive an antirotation pin 38 upon later downward movement. Furthermore, the closing seat is provided with one or more slots 39 in its outer wall which receive guide pins 40 secured through the wall of the interior unitary sleeve 20. Such guide pins 40 serve to maintain alignment of the closing seat 32 upon its subsequent movement relative to the interior unitary sleeve 20.

In some applications of the stage cementing tool it may be desirable to locate the L-shaped slot 29 and its associated antirotation and guide pin 30 at a lower position on the interior unitary sleeve 20 so that the L-shaped slot 29 and antirotation and guide pin 30 are positioned to have at least one sealing means 23 positioned below and at least one positioned above the L-shaped slot 29. Such a construction provides additional protection against the penetration of well fluids between the interior unitary sleeve 20 and the interior wall 18 of the main body portion 11 both during the cementing operation and after completion of the cementing and drilling out operations when further down-hole work is being carried out.

Figure 2:
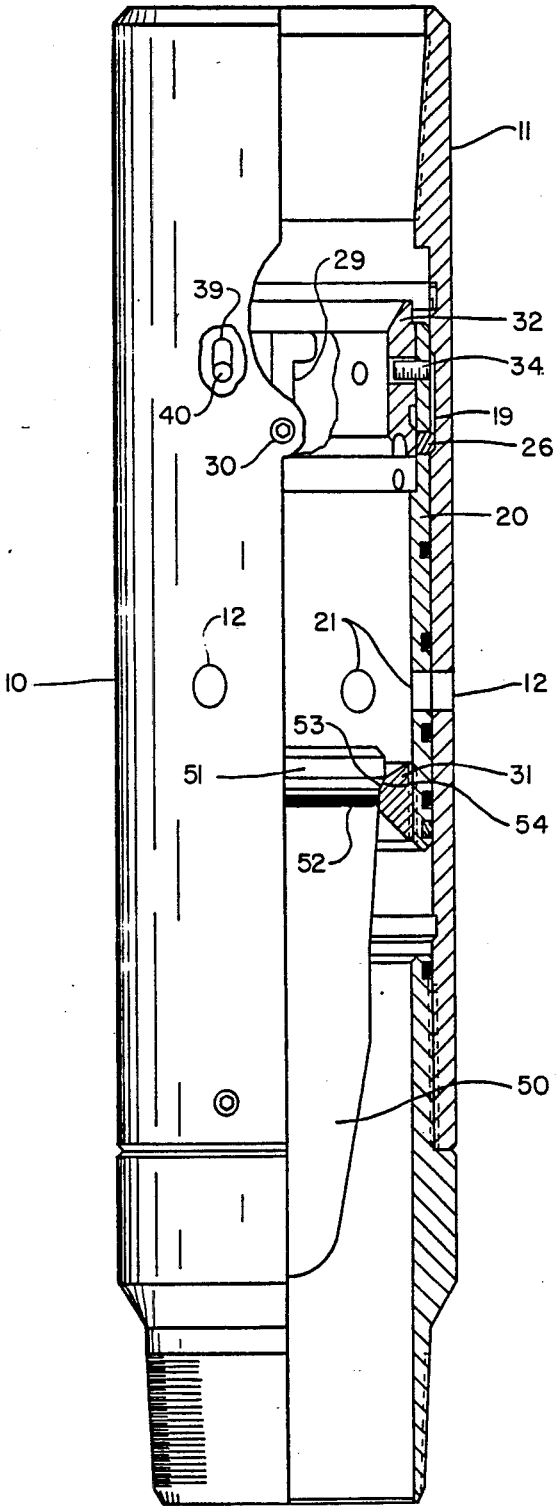
FIG. 2 is a partial section elevation of the present invention after the unitary sleeve has been moved to the open position for cement flow.

The first step after location of the casing string with the incorporated stage cementing tool 10 at the proper level for placing the desired cement plug is illustrated in FIG. 2 of the drawings. The actuation of the stage cementing tool 10 to the open or cementing position illustrated in FIG. 2 is accomplished by the action of a weighted opening cone 50. The weighted opening cone 50 is provided with a double tapered annular ring 51 at its upper end and the lower tapered surface 53 of annular ring 51 is adapted to seat against the upper tapered surface 54 of opening seat 31. An annular sealing means 52 such as an elastomeric O-ring is located in an annular recess in the opening cone 50 just below the annular ring 51. Opening cone 50 is passed down the string of casing pipe just ahead of the charge of cement to be emplaced and gravitates to the opening seat 31. It is sealed by means of annular sealing means 52 against opening seat 31 by positive pump pressure. Such positive pump pressure is increased sufficiently to sever shear pins 34 and thus drive the interior unitary sleeve 20 downward in respect to the main body portion 11 of the cementing tool. The downward travel of the interior unitary sleeve 20 is stopped by locking lugs 26 contacting the lower end of slotted recesses 19 in the inside wall of the main body portion 11. At this point apertures 21 in the interior unitary sleeve 20 are aligned with apertures 12 in the main body portion 11 and such alignment is assured by the action of antirotation and guide pin 30 seated in the main body portion 11 and carried by L-shaped slot 29 in the interior unitary sleeve 20. The open or cementing position of the cementing tool 10 which is thus achieved allows the charge of cement driven by positive pump pressure to flow out from the cementing tool via the aligned apertures 21 and 12 and into the surrounding annulus between the casing pipe and the well bore. Proper alignment of the apertures 12 and 21 has been assured by the operation of locking lugs 26 with slotted recesses 19 and antirotation and guide pine 30 with L-shaped slot 29 described above. The sealing of the opening cone 50 by means of the elastomeric O-ring annular sealing means 52 insures that none of the cement charged will leak to a lower level inside the casing pipe. During the first step of placing the stage cementing tool 10 in the open or cementing position the closing seat 32 is maintained in its same relative position as regards the interior unitary sleeve 20 by means of shear pins 34 since no severing force has been applied to that portion of pins 34. When all of the charged cement slurry has been emplaced in the annulus about the casing pipe in the well bore such cementing stage is completed.

Figure 3:
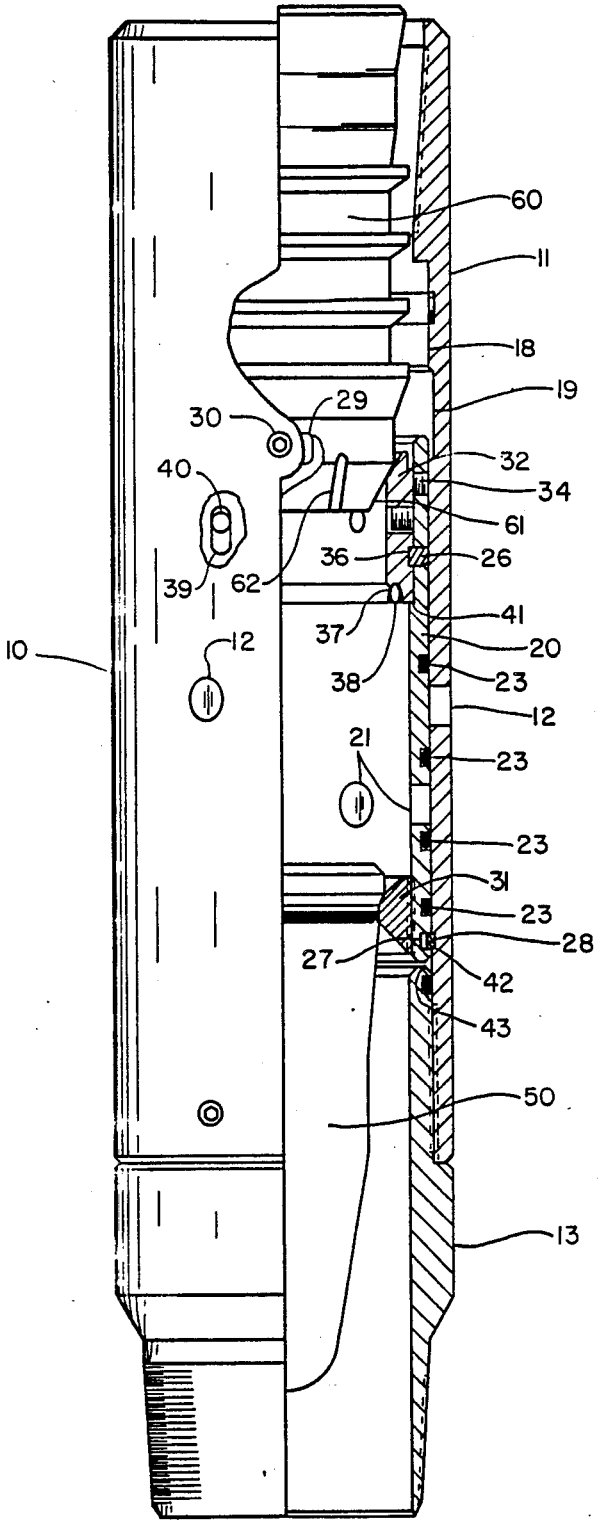
FIG. 3 is a partial section elevation of the present invention after the unitary sleeve has been moved to the fully closed and locked down position.

The movement of stage cementing tool 10 through its second step to closed position is illustrated in FIG. 3 of the drawing. Such movement to the closed position is actuated by a closing plug 60 having on its lower end a tapered surface 61 adapted to seat against the upper tapered surface of closing seat 32. The closing plug 60 is pumped down the casing string until it is seated on closing seat 32 and additional pump pressure is applied within the casing to sever shear pins 34 and force closing seat 32 downwardly until stopped by shoulder 41 on the interior wall of interior unitary sleeve 20. At the same time there are engaged the locking lugs 26 into annular groove 36 in the outer wall of closing seat 32. The arc-shaped locking lugs 26 are cammed into annular groove 36 by the tapered surface at the base of slots 19 in the interior wall 18 of main body portion 11. As the positive pump pressure from above is maintained the closing plug 60 is forced further downwardly moving with it the interior unitary sleeve 20 until stopped by the upper end 43 of the terminal sub-section 13. At this point snap ring 28 snaps outwardly and engages in the annular undercut 42 in the main body portion 11 of cementing tool 10, thus preventing any retrogressive upward movement of the interior unitary sleeve 20 or of opening seat 31 and closing seat 32 carried thereby. In the thus achieved closed position apertures 12 are fully closed by the wall of interior unitary sleeve 20 while apertures 21 in the interior unitary sleeve 20 are fully closed by the wall of main body portion 11. Both apertures 12 and 21 are sealed against seepage of well fluids by means of sealing means 23.

Closing plug 60 is also provided with slots 62 in the nose portion thereof which allow flow of any remaining cement slurry (not shown) on the inside of interior unitary sleeve 20 below closing plug 60 upward into the vacant space created by the movement of interior unitary sleeve 20 downwardly. Thus no positive pressure of the remaining cement slurry is allowed to build up because of the motion of closing plug 60 which would force closing plug 60 upwardly in the interior of cementing tool 10. As can be readily appreciated, the second step to fully closed position of stage cementing tool 10 is thus achieved and hardening and curing of the cement plug can progress without danger of seepage back into the interior of the casing below opening cone 50 or above closing plug 60.

During the initial movement of closing seat 32 downwardly after the severance of shear pins 34 the slotted recess 37 to accomodate antirotation pin 38 is maintained in alignment by means of guide pin 40 moving within slot 39 as shown in FIG. 3. After such intial downward motion antirotation pin 38 is engaged in slotted recess 37 in closing seat 32 and will continue to maintain alignment in the further downward motion of unitary sleeve 20 as well as to prevent subsequent rotation of closing seat 32 in relation to unitary sleeve 20. Furthermore, upon reaching the full downward movement of unitary sleeve 20 antirotation and guide pin 30 will engage the upper leg of L-shaped slot 29 upon initial slight rotation during subsequent drilling operations. It will thus serve as additional affirmative locking means to prevent any further rotation or movement of interior unitary sleeve 20 in relation to main body portion 11 of cementing tool 10.

After a sufficient length of time has passed for the initial hardening of the cement slurry emplaced as described above, opening and closing seats 31 and 32 as well as opening cone 50 and closing plug 60 can be removed by means of drilling out operations.

Figure 4:
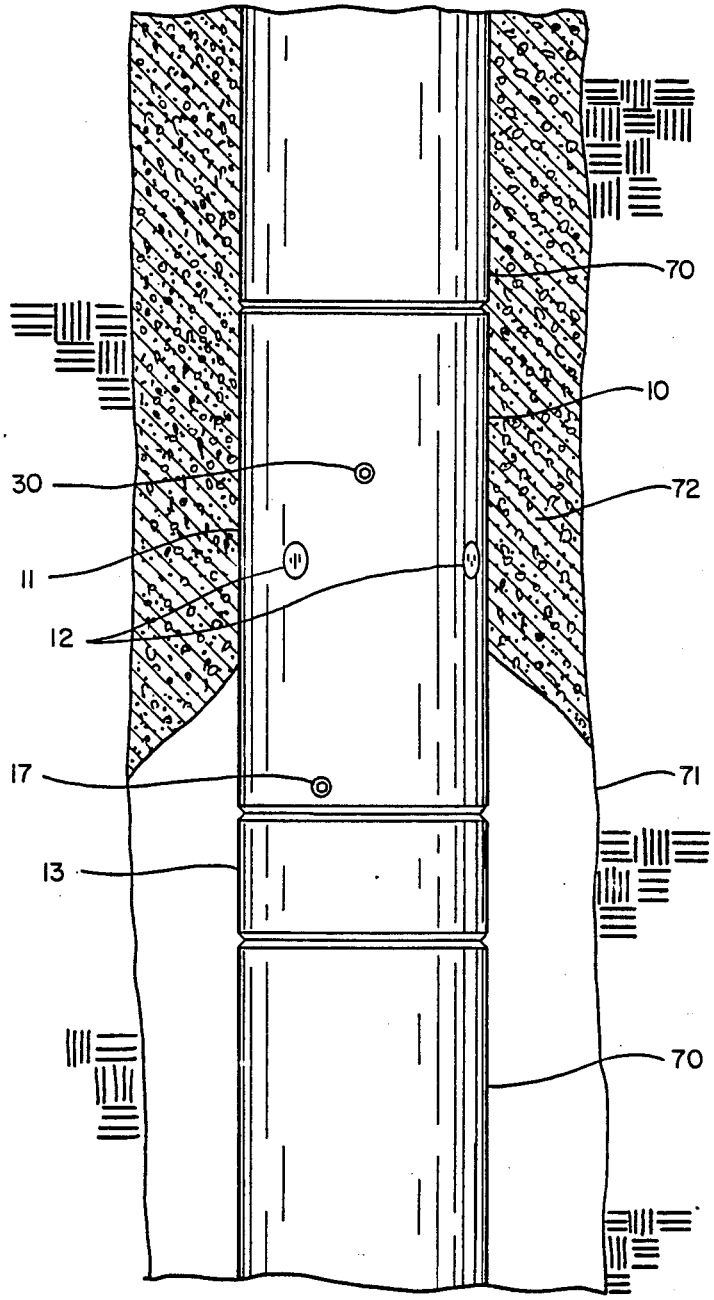
FIG. 4 is an elevation of the present invention as incorporated into a string of casing pipe which has been set and cemented into a well bore.

FIG. 4 illustrates the position of stage cementing tool 10 as incorporated in a string of casing pipe 70 after said casing has been located, set and cemented into well bore 71 by the emplacement of the cement column or cement plug 72.

Advantageously the interior elements of stage cementing tool 10 comprising opening seat 31 and closing seat 32 as well as opening cone 50 and closing plug 60 are fabricated from a softer material than the permanent main body portion 11, terminal sub section 13 and unitary sleeve 20 of the cementing tool 10. The material can advantageously comprise an aluminum alloy or other more easily machined and drilled metal, alloy or tough, heat-resistant polymeric resin such as a polycarbonate resin when compared to the steels used in the casing pipe and the permanent portions of the cementing tool described. This facilitates drilling out of the removable elements by means of a drill stem bearing a drill bit which will pass the interior walls of the permanent portions of the cementing tool 10, i.e. the main body portion 11 and the interior unitary sleeve 20 and the terminal sub-section 13. Since the walls of these permanent portions are of the same substantial thickness and are aligned with the interior walls of the casing pipe sections comprising the string of casing pipe 70, passage of such drill bit presents no substantial problem. The use of the softer materials as discussed above facilitates the drilling out operation by shortening the time necessary to remove the softer materials by the operation of the drill bit. Once these drilled out elements described have been removed by the drill bit, the drill string, with the drill bit in place, can be passed down to lower levels for continuing or further operations.

It will be apparent that the stage cementing tool of the present invention is adaptable for use in additional locations in the same string of casing pipe, if required. Thus, if a tertiary cementing operation is deemed advisable, a second stage cementing tool of the same general type can be situated lower in the casing string when it is originally passed into the well bore. The only changes desirable in the second stage cementing tool would be the use of opening and closing seats of somewhat smaller diameter than those in the stage cementing tool employed for a cementing stage at a location higher in the casing string. Likewise, the opening cone and closing plug employed with the cementing tool for tertiary cementing operations would be of slightly smaller diameter and adapted to seat on the slightly smaller opening and closing seats employed. Thus, the stage cementing tool of the present invention is well adapted for use in multiple locations in a casing string employing parts and accessory elements of the same essential design and construction and operating in the same way.

The stage cementing tool of the present invention is suitable for use with all conventional cement slurries commonly employed in well cementing operations. This tool can accommodate slurries formulated for setting at the high temperatures encountered in very deep wells as well as those employed for sealing horizons nearer the surface. Most such cement slurries are set out in the relevant API classification of cement formulations. The stage cementing tool of the present invention thus will find applications in a broad range of well cementing operations generally.

There has been shown and described a novel stage cementing tool adapted for use in secondary and teriary well cementing operations and providing all the advantages sought therefor including that of operation with a single unitary moving part. It will be apparent to those skilled in the art, after a review of this description, that many changes, modifications, variations and applications for the stage cementing tool described are possible and contemplated, and all such changes, modifications, variations and other applications which do not depart from the spirit and scope of the invention are deemed included within the present invention which is limited only by the claim set out below.

What is claimed is:

1. In a stage cementing tool adapted for placing in a pipe string consisting of:

a. a substantially tubular mandrel body threaded at a first end and carrying threaded sub-section means at the opposite end and having a plurality of circumferentially spaced first apertures through the wall thereof, b. a unitary interior sleeve means having a plurality of circumferentially spaced second apertures through the wall thereof, c. a first seat means fixedly attached within the end of said sleeve means proximate the sub-section means, d. a second seat means attached within the opposite end of said sleeve means, e. a plurality of shear pin means securing said second seat means, said sleeve means and said mandrel body and adapted for successive shearing upon application of force to different parts of the assembly of the sleeve means and the first and second seat means, the improvement consisting of, in combination:

f. set screw means fixedly attaching said threaded sub-section means to said mandrel body so as to prevent rotation of said sub-section means relative to said mandrel body, g. said unitary interior sleeve means includes at least one guide slot means having a second slot means normal to and joining with said slot means to form a continuous L-shaped slot means so as to form in combination with a guide pin secured in said mandrel body antirotation and hold down locking means, h. said second seat means includes a slotted recess means adapted to receive an antirotation pin secured in said unitary sleeve means, and i. said plurality of shear pin means secured in an interior wall recess in said mandrel body not extending to the outside wall surface of said mandrel body.

* * * * *